US012258815B2

(12) United States Patent
Schroder et al.

(10) Patent No.: US 12,258,815 B2
(45) Date of Patent: Mar. 25, 2025

(54) EARTH-BORING TOOLS INCLUDING ROTATABLE CUTTING ELEMENTS, ROTATABLE CUTTING ELEMENTS, AND ASSOCIATED COMPONENTS AND METHODS

(71) Applicant: Baker Hughes Oilfield Operations LLC, Houston, TX (US)

(72) Inventors: Jon David Schroder, The Woodlands, TX (US); Gregory L. Ricks, Spring, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 39 days.

(21) Appl. No.: 18/157,475

(22) Filed: Jan. 20, 2023

(65) Prior Publication Data

US 2024/0247547 A1 Jul. 25, 2024

(51) Int. Cl.

| | |
|---|---|
| ***E21B 10/43*** | (2006.01) |
| ***E21B 10/34*** | (2006.01) |
| ***E21B 10/55*** | (2006.01) |
| ***E21B 10/633*** | (2006.01) |

(52) U.S. Cl.
CPC ..... *E21B 10/43* (2013.01); *E21B 10/34* (2013.01); *E21B 10/55* (2013.01); *E21B 10/633* (2013.01)

(58) Field of Classification Search
CPC ..... E21B 10/55; E21B 10/62; E21B 10/627; E21B 10/633; E21B 10/43
See application file for complete search history.

(56) References Cited

U.S. PATENT DOCUMENTS

| | | | | |
|---|---|---|---|---|
| 3,945,681 | A | 3/1976 | White | |
| 4,553,615 | A * | 11/1985 | Grainger | E21B 10/62 175/354 |
| 4,751,972 | A * | 6/1988 | Jones | E21B 10/567 175/336 |
| 5,678,645 | A * | 10/1997 | Tibbitts | E21B 10/5673 175/429 |
| 7,604,073 | B2 | 10/2009 | Cooley et al. | |

(Continued)

FOREIGN PATENT DOCUMENTS

WO 2015/023953 A1 2/2015

OTHER PUBLICATIONS

Moss et al., U.S. Appl. No. 15/704,955 titled Earth-Boring Tools Including Rotatable Cuting Element Assemblies and Related Methods of Forming and Using the Same, filed Sep. 14, 2017.

(Continued)

*Primary Examiner* — Blake Michener
(74) *Attorney, Agent, or Firm* — Baker Hughes Company

(57) ABSTRACT

A rotatable cutting element includes a stationary portion defining a cavity with an inner wall, the inner wall extending at an angle radially away from a longitudinal axis of the stationary portion and defining a retaining region. The rotatable cutting element further includes a rotatable portion having one end thereof disposed in the cavity of the stationary portion and structure for engaging a subterranean formation at an opposing end. The rotatable cutting element also includes a retaining element extending between the rotatable portion and the stationary portion, the retaining element extending into the retaining region defined by the inner wall of the stationary portion.

17 Claims, 6 Drawing Sheets

(56) References Cited

U.S. PATENT DOCUMENTS

| | | | | |
|---|---|---|---|---|
| 8,079,431 | B1 * | 12/2011 | Cooley | E21B 10/55 175/413 |
| 8,950,516 | B2 | 2/2015 | Newman | |
| 10,100,584 | B1 | 10/2018 | Schroder et al. | |
| 10,415,317 | B2 | 9/2019 | Bomidi et al. | |
| 10,450,805 | B2 | 10/2019 | Bomidi et al. | |
| 10,450,806 | B2 | 10/2019 | Bomidi et al. | |
| 10,487,590 | B2 | 11/2019 | Schroder et al. | |
| 10,697,247 | B2 | 6/2020 | Moss, Jr. et al. | |
| 10,760,346 | B2 | 9/2020 | Schroder et al. | |
| 10,851,592 | B2 | 12/2020 | Schroder et al. | |
| 2010/0314176 | A1 * | 12/2010 | Zhang | E21B 10/567 175/428 |
| 2012/0273281 | A1 | 11/2012 | Burhan et al. | |
| 2014/0246246 | A1 | 9/2014 | Radford | |
| 2017/0191317 | A1 | 7/2017 | Burhan et al. | |
| 2017/0204672 | A1 * | 7/2017 | Yu | C22F 1/006 |
| 2017/0204674 | A1 * | 7/2017 | Russell | C22C 19/03 |
| 2018/0073303 | A1 * | 3/2018 | Bilen | C22F 1/006 |
| 2019/0032415 | A1 * | 1/2019 | Bomidi | E21B 10/55 |
| 2019/0063162 | A1 | 2/2019 | Bomidi et al. | |
| 2019/0078393 | A1 | 3/2019 | Moss, Jr. et al. | |

OTHER PUBLICATIONS

Schroder et al., U.S. Appl. No. 15/662,647, titled Movable Cutters and Devices Including One or More Seals for Use on Earth-Boring Tools in Subterranean Boreholes and Related Methods filed Jul. 28, 2017.

Schroder et al., U.S. Appl. No. 15/810,412 titled Methods of Forming Stationary Elements of Rotatable Cutting Elements for Use on Earth-Boring Tools and Stationary Elements Formed Using Such Methods, filed Nov. 13, 2017.

* cited by examiner

EARTH-BORING TOOLS INCLUDING ROTATABLE CUTTING ELEMENTS, ROTATABLE CUTTING ELEMENTS, AND ASSOCIATED COMPONENTS AND METHODS

TECHNICAL FIELD

Embodiments of the present disclosure generally relate to earth-boring operations. In particular, embodiments of the present disclosure relate to earth-boring tools, rotatable cutting elements coupled to earth-boring tools and associated components and methods.

BACKGROUND

Various earth-boring tools such as rotary drill bits (including roller cone bits and fixed-cutter or drag bits), core bits, eccentric bits, bicenter bits, reamers, and mills are commonly used in forming bore holes or wells in earth formations. Such tools often may include one or more cutting elements on a formation-engaging surface thereof for removing formation material as the earth-boring tool is rotated or otherwise moved within the borehole.

For example, fixed-cutter bits (often referred to as "drag" bits) have a plurality of cutting elements affixed or otherwise secured to a face (i.e., a formation-engaging surface) of a bit body. Cutting elements generally include a cutting surface, where the cutting surface is usually formed out of a superabrasive material, such as mutually bound particles of polycrystalline diamond. The cutting surface is generally formed on and bonded to a supporting substrate of a hard material such as cemented tungsten carbide. During a drilling operation, a portion of a cutting edge, which is at least partially defined by the peripheral portion of the cutting surface, is pressed into the formation. As the earth-boring tool moves relative to the formation, the cutting element is dragged across the surface of the formation and the cutting edge of the cutting surface shears away formation material. Such cutting elements are often referred to as "polycrystalline diamond compact" (PDC) cutting elements, or cutters.

During drilling, cutting elements are subjected to high temperatures due to friction between the cutting surface and the formation being cut, high axial loads from the weight on bit (WOB), and high impact forces attributable to variations in WOB, formation irregularities and material differences, and vibration. These conditions can result in damage to the cutting surface (e.g., chipping, spalling). Such damage often occurs at or near the cutting edge of the cutting surface and is caused, at least in part, by the high impact forces that occur during drilling. Damage to the cutting element results in decreased cutting efficiency of the cutting element. When the efficiency of the cutting element decreases to a critical level the operation must be stopped to remove and replace the drill bit or damaged cutters, which is a large expense for an operation utilizing earth-boring tools.

Securing a PDC cutting element to a drill bit by conventional approaches restricts the useful life of such cutting element, as only a portion of the cutting edge of the diamond table engages the formation and wears down, as does the substrate, creating a so-called "wear flat," necessitating increased weight on bit to maintain a given rate of penetration of the drill bit into the formation due to the increased surface area presented by the cutting element. In addition, unless the cutting element is, after the drill bit is pulled from the wellbore, heated to liquefy a braze alloy securing the substrate of the cutting element to the bit body so as to remove it from the bit and then rotated about its longitudinal axis and rebrazed with an unworn portion of the cutting edge presented for engaging a formation, more than half of the cutting element is never used.

Rotatable cutting elements are cutting elements that are able to rotate, either through free rotation or through the engagement of the formation with features on the cutting element configured to force rotation of the cutting element while the associated drill bit is operating down hole. Rotatable cutting elements may provide more even wear across an entire edge of the cutting element, extending the life of the cutting element and the associated drill bit.

BRIEF SUMMARY

Embodiments of the disclosure include a rotatable cutting element. The rotatable cutting element includes a stationary portion defining a cavity with an inner wall, the inner wall extending at an angle radially away from a longitudinal axis of the stationary portion and defining a retaining region. The rotatable cutting element further includes a rotatable portion having one end thereof disposed in the cavity of the stationary portion and structure for engaging a subterranean formation at an opposing end. The rotatable cutting element also includes a retaining element extending between the rotatable portion and the stationary portion, the retaining element extending into the retaining region defined by the inner wall of the stationary portion.

Another embodiment of the disclosure includes an earth-boring tool. The earth-boring tool includes a body and a rotatable cutting element secured to the body. The rotatable cutting element includes a sleeve secured to the body, the sleeve defining a cavity. The rotatable cutting element further includes a rotatable element disposed in the cavity of the sleeve, the rotatable element including a cutting table and a spindle, the spindle extending into the cavity. The rotatable cutting element also includes a retaining element extending between a retaining groove defined in the spindle and a retaining surface defined in the cavity, the retaining element comprising a shaped memory alloy.

Another embodiment of the disclosure includes a method of assembling a rotatable cutting element. The method includes training a shaped memory alloy ring to a conical shape. The method further includes lowering a temperature of the shaped memory alloy ring to below a trigger temperature of the shaped memory alloy ring. The method also includes compressing the shaped memory alloy ring into a retaining groove on a spindle of a rotatable portion of the rotatable cutting element. The method further includes disposing the spindle of the rotatable portion into a cavity defined in a stationary portion of the rotatable cutting element. The method also includes heating the rotatable cutting element to a temperature above the trigger temperature of the shaped memory alloy ring.

BRIEF DESCRIPTION OF THE DRAWINGS

While the specification concludes with claims particularly pointing out and distinctly claiming embodiments of the present disclosure, the advantages of embodiments of the disclosure may be more readily ascertained from the following description of embodiments of the disclosure when read in conjunction with the accompanying drawings in which:

DETAILED DESCRIPTION

Figure 1:
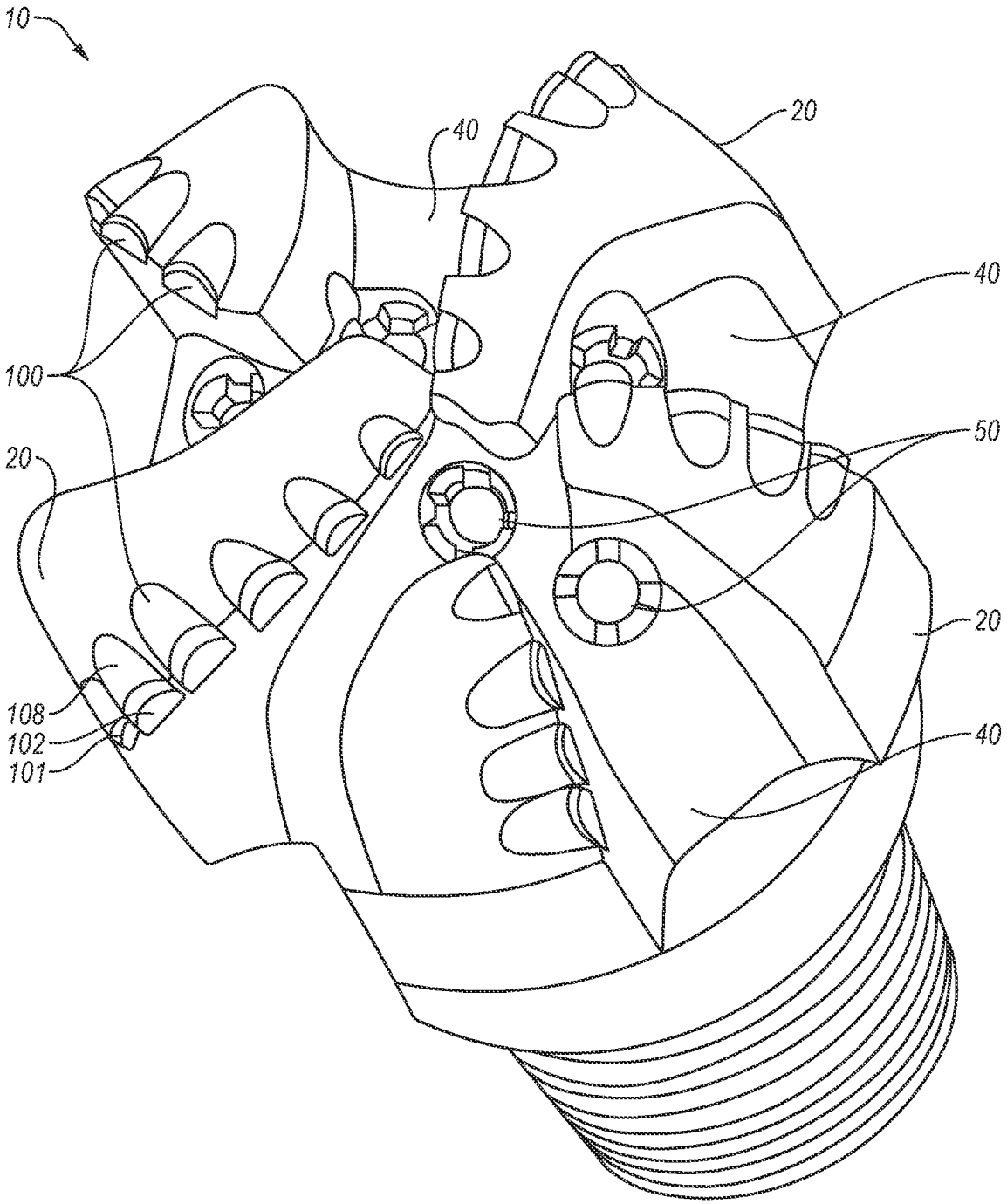
FIG. 1 illustrates a perspective view of an earth-boring tool in accordance with an embodiment of the present disclosure.

The illustrations presented herein are not meant to be actual views of any particular earth-boring tool or cutting element, but are merely idealized representations employed to describe illustrative embodiments. The drawings are not necessarily to scale.

As used herein, the term "earth-boring tool" means and includes any type of bit or tool used for drilling during the formation or enlargement of a wellbore in a subterranean formation. For example, earth-boring tools include fixed-cutter bits, roller cone bits, percussion bits, core bits, eccentric bits, bicenter bits, reamers, mills, drag bits, hybrid bits (e.g., rolling components in combination with fixed cutting elements), and other drilling bits and tools known in the art.

As used herein, the term "substantially" in reference to a given parameter means and includes to a degree that one skilled in the art would understand that the given parameter, property, or condition is met with a small degree of variance, such as within acceptable manufacturing tolerances. By way of example, depending on the particular parameter, property, or condition that is substantially met, the parameter, property, or condition may be at least 90.0 percent met, at least 95.0 percent met, at least 99.0 percent met, at least 99.9 percent met, or even 100.0 percent met.

As used herein, "about" or "approximately" in reference to a numerical value for a particular parameter is inclusive of the numerical value and a degree of variance from the numerical value that one of ordinary skill in the art would understand is within acceptable tolerances for the particular parameter. For example, "about" or "approximately" in reference to a numerical value may include additional numerical values within a range of from 90.0 percent to 110.0 percent of the numerical value, such as within a range of from 95.0 percent to 105.0 percent of the numerical value, within a range of from 97.5 percent to 102.5 percent of the numerical value, within a range of from 99.0 percent to 101.0 percent of the numerical value, within a range of from 99.5 percent to 100.5 percent of the numerical value, or within a range of from 99.9 percent to 100.1 percent of the numerical value.

As used herein, the term "and/or" means and includes any and all combinations of one or more of the associated listed items.

Referring to FIG. 1, a perspective view of an earth-boring tool 10 in the form of rotary drill bit is shown. The earth-boring tool 10 may have blades 20 in which a plurality of cutting elements 100 may be secured. The cutting elements 100 may have a cutting table 101 with a cutting face 102 which may form the cutting profile of the earth-boring tool 10. The cutting elements 100 may also include a substrate 108 configured to support the cutting table 101. The substrate 108 may be secured to the blade 20 within a cutting element pocket formed in the blade 20. For example, each cutting element may be welded, soldered, brazed, etc., to the blade 20 within a cutting element pocket formed therein.

The earth-boring tool 10 may rotate about a longitudinal axis of the earth-boring tool 10 during use thereof. When the earth-boring tool 10 rotates, the cutting face 102 of the cutting elements 100 may contact the earth formation and remove material therefrom. The material removed by the cutting faces 102 may then be removed through the junk slots 40. The earth-boring tool 10 may include nozzles 50, through which fluid, such as water or drilling mud, may be introduced into the area around the blades 20 to aid in removing the sheared material and other debris from the area around the blades and/or to cool the cutting elements 100 and the blades 20.

Figure 2:
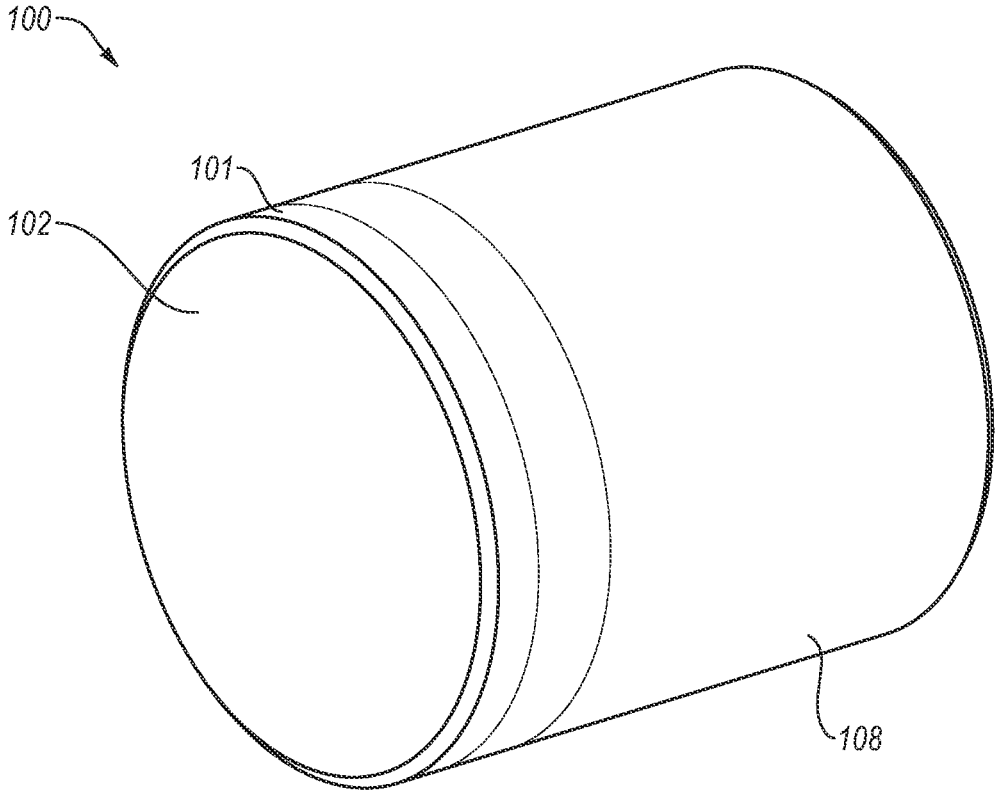
FIG. 2 illustrates perspective view of a rotatable cutting element in accordance with embodiments of the disclosure.

FIG. 2 illustrates a perspective view of a rotatable cutting element 100 in accordance with embodiments of the present disclosure. The rotatable cutting element 100 may comprise the cutting table 101 with the cutting face 102 and a substrate 108. The cutting table 101 may be formed from a polycrystalline material, such as, for example, polycrystalline diamond or polycrystalline cubic boron nitride. The rotatable cutting element 100 may be secured to the earth-boring tool 10 (FIG. 1) by fixing the exterior surface of the substrate 108 to the earth-boring tool 10. This is commonly achieved through a brazing process. The cutting table 101 is configured to rotate relative to at least a portion of the substrate 108, such that the exterior surface of the 108 may be secured to the earth-boring tool 10 and the cutting table 101 may rotate relative to the earth-boring tool 10.

Figure 3:
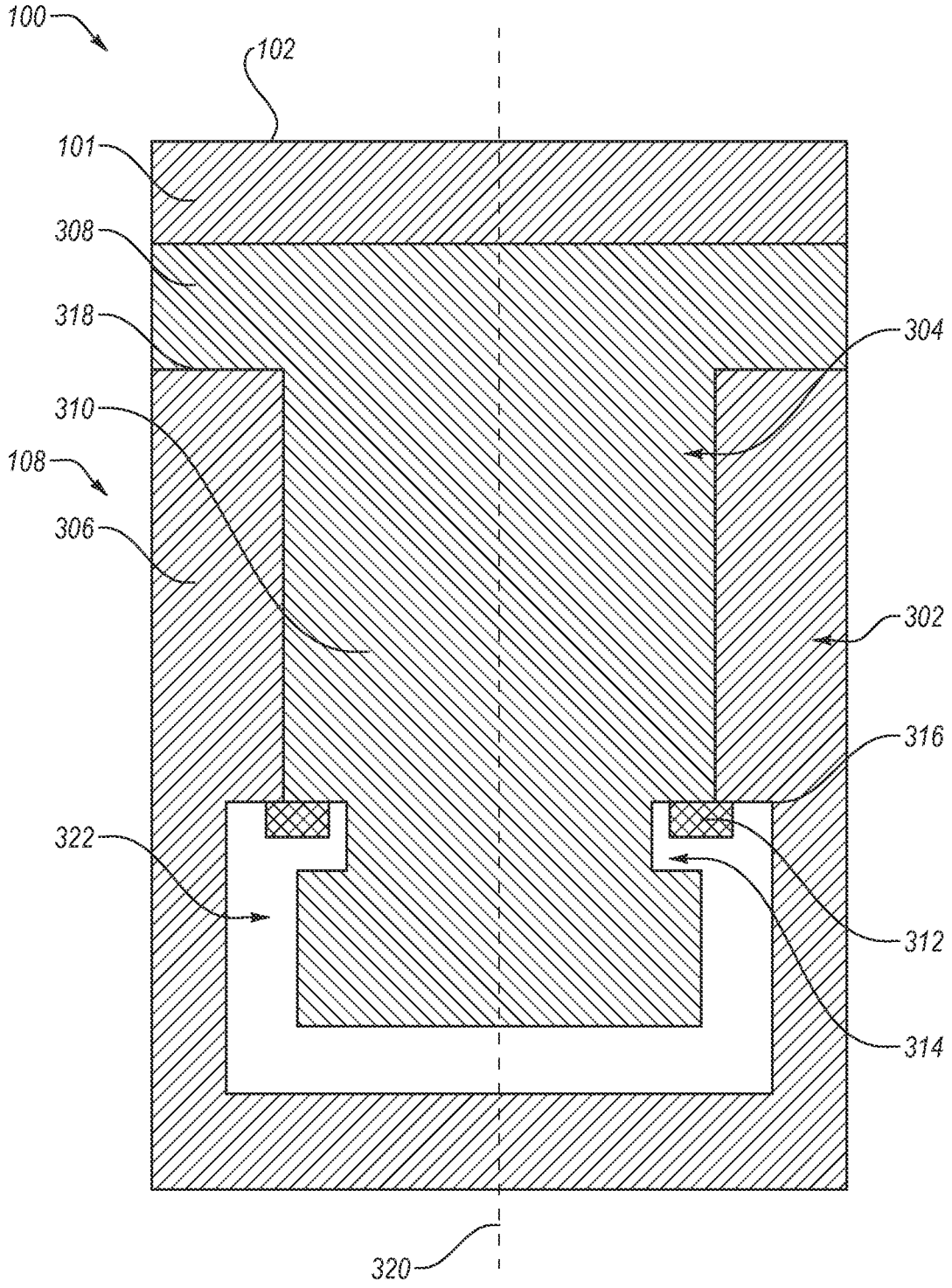
FIG. 3 is a schematic cross-sectional illustration of the rotatable cutting element of FIG. 2.

FIG. 3 illustrates a simplified cross-sectional schematic illustration of the rotatable cutting element 100 of FIG. 2. The rotatable cutting element 100 may include a stationary portion 302 and a rotatable portion 304. The stationary portion 302 may include a sleeve 306. The sleeve 306 may form a portion of the substrate 108 including the outer surface of the substrate 108 that is secured to the earth-boring tool 10 (FIG. 1). The sleeve 306 defines a cavity 322 into which a portion of the rotatable portion 304 is disposed.

The rotatable portion 304 may include a spindle 310 configured to extend into the cavity 322 defined in the sleeve 306. The rotatable portion 304 may also include a shoulder 308 configured to extend laterally over an upper end surface of the sleeve 306 and form an interface 318 between the upper end surface of the sleeve 306 and a lower surface of the shoulder 308 on the rotatable portion 304. The spindle 310 and a portion of the shoulder 308 form an additional rotatable portion 304 of the substrate 108 (and the cutting element 100). As described above, the cutting table 101 is fixed to the rotatable portion 304, and will rotate together with the rotatable portion 304.

The substrate 108 and the cutting table 101 may each be formed from different hard materials. For example, the cutting table 101 may be formed from a super-hard material, such as polycrystalline diamond or polycrystalline cubic boron nitride. The components of the substrate 108 may be formed from another hard material suitable for use in an earth-boring operation, such as a metal, an alloy (e.g., steel), a ceramic-metal composite material (e.g., cobalt-cemented tungsten carbide), or combinations thereof.

The spindle 310 of the rotatable portion 304 and the cavity 322 of the stationary portion 302 may have substantially complementary shapes. For example, the cavity 322 and the spindle 310 may each have a cylindrical shape and the spindle 310 may have a major dimension (e.g., diameter or radius) that is slightly less than a major dimension of the cavity 322, such that the spindle 310 may rotate within the cavity 322 with little to no friction. The rotatable portion 304 and the stationary portion 302 may be substantially coaxial, such that each of the stationary portion 302 and the rotatable portion 304 may have a same longitudinal axis 320, which may also be the rotational and longitudinal axis 320 of the rotatable cutting element 100. The sleeve 306 may substantially surround the spindle 310, which may substantially prevent radial movement of the rotatable portion 304 relative to the stationary portion 302 to maintain the substantially coaxial relationship between the stationary portion 302 and the rotatable portion 304.

The rotatable portion 304 may be retained within the sleeve 306 by a retaining element 312 that may mechanically engage with each of a retaining face 316 of the sleeve 306 and a retaining groove 314 of the spindle 310 so as to retain the rotatable portion 304 within the stationary portion 302. In some embodiments, the retaining element 312 is formed as a ring having an opening between two ends of the ring, such that the ring has a C-shape. The opening may facilitate compression and expansion of the ring. For example, the ring may be expanded by applying a radially outward force increasing a size of the opening, such as to fit the ring around the spindle 310. The ring may be compressed by applying a radially inward force to decrease a size of the opening, such as to compress the ring into the retaining groove 314 for assembly or disassembly as described below. The retaining element 312 may be formed from a spring-like material having a large yield strength and a large elastic modulus, such that the retaining element 312 can be deformed (e.g., compressed or expanded) and will return to its original shape, such as the C-shaped ring. The retaining element 312 may be configured to limit axial movement of the rotatable portion 304 relative to the stationary portion 302. For example, the retaining element 312 may be configured to allow limited axial movement between the rotatable portion 304 and the stationary portion 302 while maintaining sufficient space there between to establish a relatively low friction interface between the rotatable portion 304 and the stationary portion 302 to facilitate rotating the rotatable portion 304 relative to the stationary portion 302 during operation.

To facilitate assembly and/or disassembly of the rotatable cutting elements 100, as well as rotation of the rotatable portion 304 relative to the stationary portion 302, clearance may be included at each interface, such as between the retaining groove 314 and the retaining element 312, between the retaining element 312 and the retaining face 316. A gap at the interface 318 between the upper end surface of the sleeve 306 and a lower surface of the shoulder 308 results from the combination of the clearances at each interface. The individual clearances may be in a range from about 0.005 inches (0.127 mm) to about 0.05 inches (1.27 mm), such as between about 0.005 inches (0.127 mm) and about 0.02 inches (0.508 mm). After the rotatable cutting element 100 is assembled, the individual clearances may combine (e.g., through clearance stack-up), to create a larger overall clearance between the upper end surface of the sleeve 306 and a lower surface of the shoulder 308. This may allow large amounts of axial movement between the rotatable portion 304 and the stationary portion 302. Large amounts of axial movement can result in debris entering the internal spaces between the stationary portion 302 and the rotatable portion 304, such as at the interface 318 or within the cavity 322. This debris may cause damage to the interface 318, internal surfaces within the cavity 322, spindle 310, and other parts of the rotatable cutting elements 100, which may reduce the operational life of the rotatable cutting element 100. In other cases, the debris may prevent the rotatable portion 304 from rotating as intended relative to the stationary portion 302, which may negate the benefits of a rotatable cutting element. Thus, limiting the axial movement of the rotatable portion 304 relative to the stationary portion 302 may increase an operational life of the associated rotatable cutting element 100. FIGS. 4A through 7 illustrate different examples of retaining elements 312 and interfaces between the retaining elements 312 and the spindle 310 and the sleeve 306.

Figure 4A:
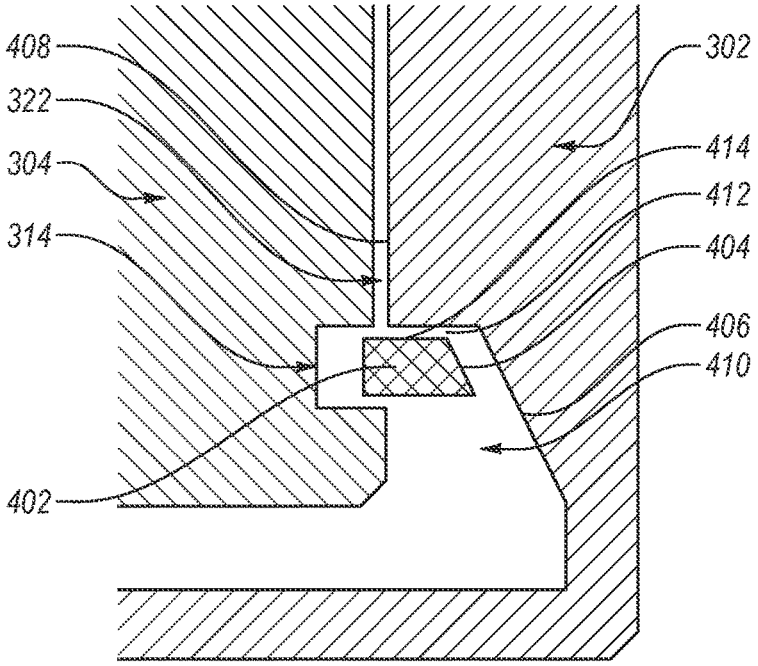
FIGS. 4A and 4B illustrate enlarged cross-sectional views of an embodiment of a retaining interface between a rotatable portion and stationary portion of the cutting element of FIGS. 2 and 3.
Figure 4B:
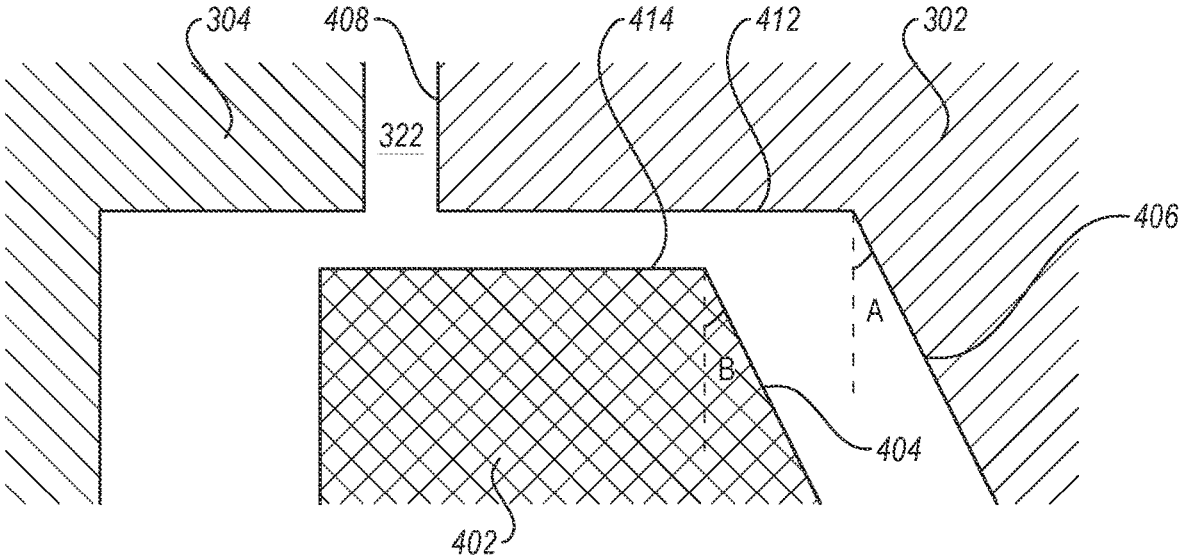

FIGS. 4A and 4B illustrate enlarged views of an interface between a retaining element 402 and the retaining portions of the rotatable portion 304 and the stationary portion 302. As illustrated in FIG. 4A, an inner wall 408 of the stationary portion 302 may extend radially away from the rotatable portion 304 in a plane passing through the longitudinal axis 320 (FIG. 3), such that the cross-sectional area of the cavity 322 is larger in a lower retaining region 410 than in an upper region of the cavity 322. As shown in FIG. 4B, the inner wall 408 in the retaining region 410 may include a retaining face 412 and a biasing face 406. The biasing face 406 may extend at an angle A relative to the longitudinal axis 320 (FIG. 3) of the cutting element 100. The retaining face 412 extends in a direction substantially transverse to the longitudinal axis 320 (FIG. 3) of the cutting element 100 and may be configured to interface with a top surface 414 of the retaining element 402 to substantially prevent the rotatable portion 304 from moving axially beyond the interface between the top surface 414 of the retaining element 402 and the retaining face 412.

The biasing face 406 may be configured to interface with the retaining element 402 by gradually increasing or decreasing a frictional force on a biasing interface surface 404 of the retaining element 402 as the rotatable portion 304 is urged in an axial direction along the longitudinal axis 320 (FIG. 3). This may limit the axial motion of the rotatable portion 304 before the top surface 414 of the retaining element 402 reaches the retaining face 412.

In some embodiments, the angle A of the biasing face 406 is selected to provide a large change in frictional force over a relatively small change in axial position. For example, the angle A may be between about 45° and about 89°, such as between about 60° and about 89°, or between about 80° and about 89°. The biasing interface surface 404 may extend at an angle B relative to the longitudinal axis 320 (FIG. 3). The angle A of the biasing face 406 and the angle B of the biasing interface surface 404 may be similar. The biasing face 406 and the biasing interface surface 404 extending at similar angles A and B, may result in an increase in contact area between the biasing interface surface 404 and the biasing face 406. The angle B of the biasing interface surface 404 may be substantially the same as the angle A of the biasing face 406, such as within +/−20° of the angle A of the biasing face 406, or within +/−10° of the angle A of the biasing face 406, or within about +/−5° of the angle A of the biasing face 406.

As described above, the retaining element 402 may be formed from a substantially rigid spring-like material capable of withstanding the high temperatures and pressures in a downhole environment while maintaining a high yield strength and having a high modulus of elasticity. When assembled the retaining element 402 may be elastically compressed into the retaining groove 314. Once the retaining element 402 and retaining groove 314 are substantially axially aligned with the retaining region 410, the retaining element 402 is configured to expand or bias in a radial direction away from the longitudinal axis 320 (FIG. 3) to return to its original, un-compressed shape. For example, the retaining element 402 may be formed from a metal or metal alloy, such as steel, iron, stainless steel, nickel based alloys, chromium, etc., or a high temperature polymer, such as polytetrafluoroethylene (PTFE). The original, un-compressed shape of the retaining element 402 may be sufficiently large, that the retaining element 402 may extend until the biasing interface surface 404 of the retaining element 402 contacts the biasing face 406 of the stationary portion 302. As the retaining element 402 extends, the angles A and B of the biasing face 406 and the biasing interface surface 404 may cause the rotatable portion 304 to move axially into the stationary portion 302. The angles A and B may be selected such that the retaining element 402 may fully extend before the shoulder 308 (FIG. 3) reaches the interface 318 (FIG. 3), such that a clearance is maintained between the upper end surface of the sleeve 306 (FIG. 3) and a lower surface of the shoulder 308 (FIG. 3) to facilitate rotation of the rotatable portion 304 relative to the stationary portion 302. The interface 318 (FIG. 3) between the shoulder 308 (FIG. 3) of the rotatable portion 304 and the stationary portion 302 may limit the axial movement of the rotatable portion 304 into the stationary portion 302, while the interface between the biasing interface surface 404 of the retaining element 402 and the biasing face 406 of the stationary portion 302 may limit the axial movement of the rotatable portion 304 out of the stationary portion 302.

Figure 5A:
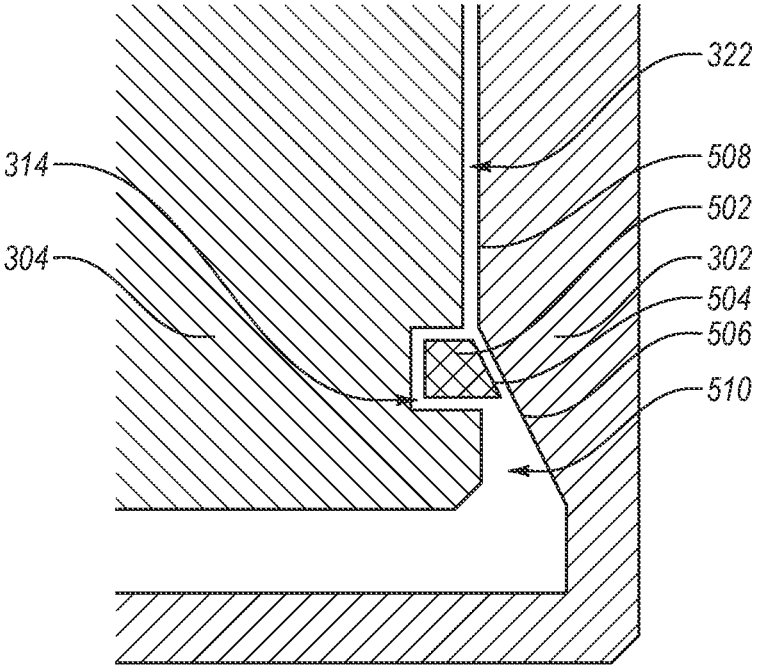
FIGS. 5A and 5B illustrate enlarged cross-sectional views of another embodiment of a retaining interface between a rotatable portion and stationary portion of the cutting element of FIGS. 2 and 3.
Figure 5B:
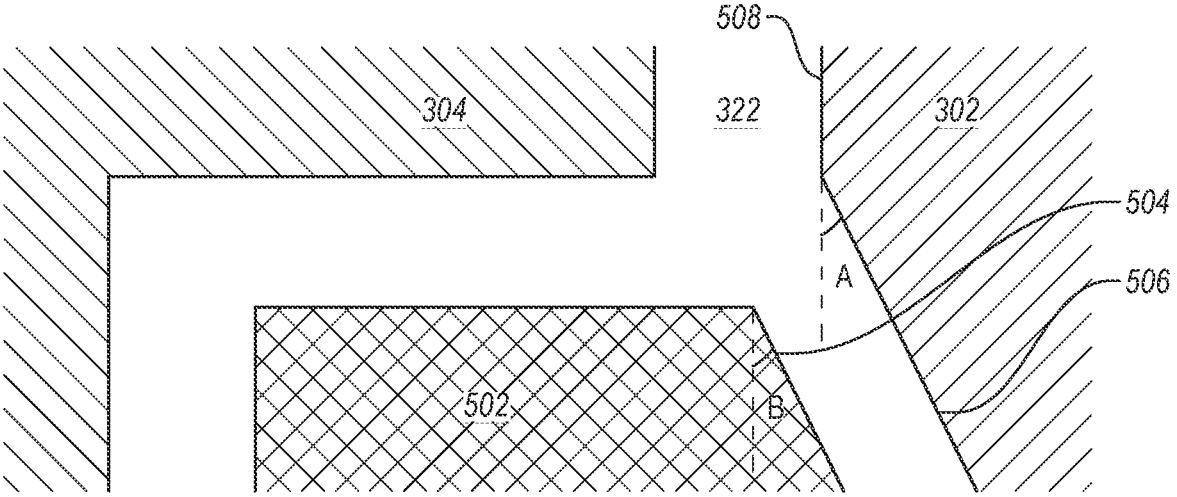

FIGS. 5A and 5B illustrate enlarged views of another embodiment of the interface between a retaining element 502 and the retaining portions of the rotatable portion 304 and the stationary portion 302. As illustrated in FIGS. 5A and 5B, an inner wall 508 of the stationary portion 302 extends radially away from the rotatable portion 304 in a plane passing through the longitudinal axis 320 (FIG. 3), such that the cross-sectional area of the cavity 322 is larger in a lower retaining region 510 than in an upper region of the cavity 322. As shown in FIG. 5B, inner wall 408 in the retaining region 410 includes a biasing face 506. The biasing face 506 extends at an angle A relative to the longitudinal axis 320 (FIG. 3) of the cutting element 100. The biasing face 506 may be configured to interface with the retaining element 502 by gradually increasing or decreasing a frictional force on a biasing interface surface 504 of the retaining element 502 as the rotatable portion 304 moves in an axial direction.

In some embodiments, the angle A of the biasing face 506 is selected to provide a large change in frictional force over a relatively small change in axial position. For example, the angle A may be between about 45° and about 89°, such as between about 60° and about 89°, or between about 80° and about 89°. The biasing interface surface 504 may extend at an angle B relative to the longitudinal axis 320 (FIG. 3). The angle A of the biasing face 506 and the angle B of the biasing interface surface 504 may be similar. The biasing face 506 and the biasing interface surface 504 extending at similar angles A and B, may result in an increase in contact area between the biasing interface surface 504 and the biasing face 506. The angle B of the biasing interface surface 504 may be substantially the same as the angle A of the biasing face 506, such as within +/−20° of the angle A of the biasing face 506, or within +/−10° of the angle A of the biasing face 506, or within about +/−5° of the angle A of the biasing face 506.

As described above, the retaining element 502 may be formed from a substantially rigid spring-like material capable of withstanding the high temperatures and pressures in a downhole environment while maintaining a high yield strength and having a high modulus of elasticity. When assembled the retaining element 502 may be elastically compressed into the retaining groove 314. Once the retaining element 502 and retaining groove 314 are substantially radially aligned with the retaining region 510, the retaining element 502 is configured to expand or bias in a radial direction away from the longitudinal axis 320 (FIG. 3) to return to its original, un-compressed shape. For example, the retaining element 502 may be formed from a metal, such as steel, iron, stainless steel, nickel based alloys, chromium, etc., or a high temperature polymer, such as polytetrafluoroethylene (PTFE). The original, un-compressed shape of the retaining element 502 may be sufficiently large, that the retaining element 502 may extend until the biasing interface surface 504 of the retaining element 502 contacts the biasing face 506 of the stationary portion 302. As the retaining element 502 extends the angles A and B of the biasing face 506 and the biasing interface surface 504 may cause the rotatable portion 304 to move axially into the stationary portion 302. The angles A and B may be selected such that the retaining element 502 may fully extend before the shoulder 308 (FIG. 3) reaches the interface 318 (FIG. 3), such that a clearance is maintained between the upper end surface of the sleeve 306 (FIG. 3) and a lower surface of the shoulder 308 (FIG. 3) to facilitate rotation of the rotatable portion 304 relative to the stationary portion 302. The interface 318 (FIG. 3) between the shoulder 308 (FIG. 3) of the rotatable portion 304 and the stationary portion 302 may limit the axial movement of the rotatable portion 304 into the stationary portion 302, while the interface between the biasing interface surface 504 of the retaining element 502 and the biasing face 506 of the stationary portion 302 may limit the axial movement of the rotatable portion 304 out of the stationary portion 302.

As illustrated in FIGS. 5A and 5B, some embodiments do not include a retaining face. The exclusion of the retaining face may facilitate the removal of the rotatable portion 304 from the stationary portion 302. For example, an axial force may be applied to the rotatable portion 304 in a direction out of the stationary portion 302. As the rotatable portion 304 moves axially out of the stationary portion 302, the interface between the biasing interface surface 504 of the retaining element 502 and the biasing face 506 of the stationary portion 302 may cause the retaining element 502 to be compressed into the retaining groove 314 of the rotatable portion 304. The axial force may be sufficient to cause the retaining element 502 to retract fully into the retaining groove 314, such that the retaining element 502 has an outer diameter less than or equal to a diameter of the inner wall 508 in the region axially above the retaining region 510. This may facilitate removing the rotatable portion 304 from the stationary portion 302, such as for repair, reprocessing or replacement.

Figure 6A:
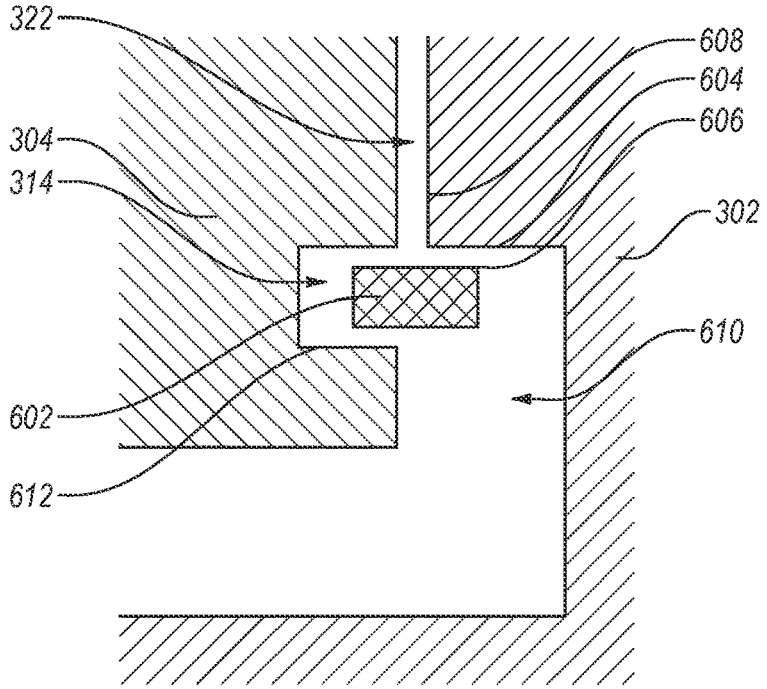
FIGS. 6A and 6B illustrated enlarged cross-sectional views of another embodiment of a retaining interface between a rotatable portion and stationary portion of the cutting element of FIGS. 2 and 3.
Figure 6B:
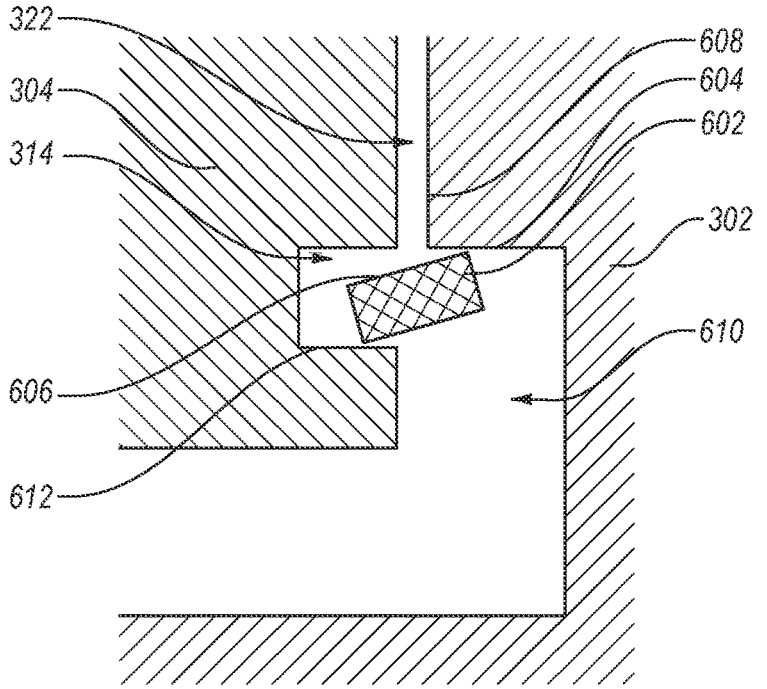

FIGS. 6A and 6B illustrate enlarged views of another embodiment of the interface between a retaining element 602 and the retaining portions of the rotatable portion 304 and the stationary portion 302. As illustrated in FIGS. 6A and 6B, an inner wall 608 of the stationary portion 302 extends radially away from the rotatable portion 304 increasing a cross-sectional area of the cavity 322 to form a retaining region 610. The inner wall 608 in the retaining region 610 includes a retaining face 604. The retaining face 604 extends in a direction substantially transverse to the longitudinal axis 320 (FIG. 3) of the cutting element 100 and may interface with a top surface 606 of the retaining element 602 to substantially prevent the rotatable portion 304 from moving axially beyond the interface between the top surface 606 of the retaining element 602 and the retaining face 604.

In some embodiments, the retaining element 602 is formed from a shape memory alloy. The shape memory alloy is a metal alloy configured to change shape when exposed to a triggering condition, such as a triggering temperature. Shape memory alloys may include Nickel Titanium alloys, such as Nitinol (NiTi), Nickel Titanium Cobalt (NiTi—Co), Nickel Titanium Copper (NiTi—Cu), Nickel Titanium Chromium (NiTi—Cr), and Nickel Titanium Vanadium (NiTi—V). The retaining element 602 may have a ring shape, such as a C-shaped ring, similar to the embodiments described above. The retaining element 602 may be trained to move into a conical ring shape when triggered, as illustrated in FIG. 6B, such that the retaining element 602 may act as a biasing element, such as a spring or Belleville washer. The conical shape may cause the retaining element 602 to extend between the retaining face 604 of the stationary portion 302 and an inner face 612 of the retaining groove 314 with the top surface 606 of the retaining element 602 forming an acute angle (e.g., an angle between about 5° and about 30°, such as between about 10° and about 20°) relative to the respective faces 604, 612.

The retaining element 602 may act as a biasing element, such that the resting shape of the retaining element 602 may apply an inward axial force to the rotatable portion 304 and any outward axial movement of the rotatable portion 304 may be resisted by a deformation force in the retaining element 602. Thus, the interface 318 (FIG. 3) between the shoulder 308 (FIG. 3) of the rotatable portion 304 and the stationary portion 302 may limit the axial movement of the rotatable portion 304 into the stationary portion 302, while the deformation force in the 602 coupled with the interfaces between the retaining element 602 and the retaining face 604 and the retaining element 602 and the inner face 612 of the 314 may limit the axial movement of the rotatable portion 304 out of the stationary portion 302.

The shape memory alloy of the retaining element 602 may be configured to trigger at a temperature higher than ambient temperature (e.g., about 25° C.). In some embodiments, the retaining element 602 is configured to trigger at or around temperatures that are typical of a downhole environment. For example, the retaining element 602 may be configured to trigger at a temperature between about 100° F. and about 900° F., such as between about 150° F. and about 600° F., or between about 300° F. and about 350° F. In some embodiments, the cutting element 100 will be assembled and a triggering temperature will be applied to the cutting element 100 as part of the assembly process. In another embodiment, the cutting element 100 will be assembled and the downhole environment will be relied on to provide the triggering temperature, such that the retaining element 602 will change shape to the conical biasing shape after the cutting element 100 is inserted into the wellbore. In a further embodiment, the shape memory alloy of the retaining element 602 may be configured to trigger at around or slightly below ambient temperature, so that the retaining element 602 may be cooled substantially below ambient in a freezer or by dry ice, inserted and triggered by ambient heat of the drill bit.

A rotating cutting element 100 including a shaped memory alloy retaining element 602 may be assembled by first training the shaped memory alloy retaining element 602 to the desired shape (e.g., conical shape) at the desired trigger temperature. Typically, a shaped memory alloy is trained by securing the alloy in the desired shape and holding the alloy in that shape at the desired temperature for a time period, such as between about five minutes and an hour, or between about ten minutes and thirty minutes. After the time period the shaped memory alloy is rapidly cooled.

When the temperature of the retaining element 602 is reduced or lowered to a temperature below the trigger temperature, such as ambient temperature, the retaining element 602 may then be compressed into the retaining groove 314 of the rotatable portion 304, such as by reducing a size of the opening between the ends of a C-shaped ring. The retaining element may be deformed to a flat disc or ring shape. Additional tooling such as a ring compressor may be used to compress the retaining element 602 fully into the retaining groove 314, such that the rotatable portion 304 may be inserted into the cavity 322 defined in the stationary portion 302. The rotatable portion 304 may be axially inserted or disposed into the cavity 322 with the inner wall 608 securing the retaining element 602 in the retaining groove 314 until the retaining groove 314 and retaining element 602 reach the retaining region 610.

In the retaining region 610, the inner wall 608 extends radially away from the rotatable portion 304, such that the retaining element 602 may extend away from the retaining groove 314 into the retaining region 610. In some embodiments, the retaining region 610 may also include a biasing face (e.g., biasing face 406), as illustrated in FIGS. 4A and 4B and described above. In some embodiments, the cutting element 100 is then manually heated, such as in a furnace, kiln, or with a heat gun or other heating device, to a temperature above the triggering temperature, such that the retaining element 602 returns to the desired trained shape and biases the rotatable portion 304 into the stationary portion 302. In other embodiments, the cutting element 100 is stored at ambient temperatures and the cutting element 100 is transported to the worksite without triggering the shaped memory alloy of the retaining element 602. The cutting element 100 is then tripped into a borehole on an earth-boring tool where the heat of the downhole environment and/or heat generated by friction triggers the shaped memory alloy into the desired or trained shape, such that the retaining element 602 biases the rotatable portion 304 into the stationary portion 302 further limiting the axial movement of the rotatable portion 304.

Embodiments of the present disclosure may extend the operating life of cutting elements by limiting damage to the cutting elements and facilitating rotation of the rotatable cutter by substantially preventing binding, clogging, and other debris related impediments to the free rotation of the rotatable cutting element. This may provide a cutting element with improved wear characteristics of a cutting surface that may result in a longer service life for the rotatable cutting elements. Extending the life of the rotatable cutting elements may in turn, extend the life of the earth-boring tool to which they are attached. Replacing earth-boring tools or even tripping out an earth-boring tool to replace worn or damaged cutters is a large expense for earth-boring operations. Often earth-boring tools are on a distal end of a drill string that can be in excess of 40,000 feet long. The entire drill string must be removed from the borehole to replace the earth-boring tool or damaged cutters. Extending the life of the earth-boring tool may result in significant cost savings for the operators of an earth-boring operation.

The embodiments of the disclosure described above and illustrated in the accompanying drawing figures do not limit the scope of the invention, since these embodiments are merely examples of embodiments of the invention, which is defined by the appended claims and their legal equivalents. Any equivalent embodiments are intended to be within the scope of this disclosure. Indeed, various modifications of the present disclosure, in addition to those shown and described herein, such as alternative useful combinations of the elements described, may become apparent to those skilled in the art from the description. Such modifications and embodiments are also intended to fall within the scope of the appended claims and their legal equivalents.

What is claimed is:

1. A rotatable cutting element, comprising:

a stationary portion defining a cavity with an inner wall, wherein the inner wall comprises a surface extending at a constant angle radially away from a longitudinal axis of the stationary portion and defining a retaining region, the constant angle being between 89° and 80°;

a rotatable portion having one end thereof disposed in the cavity of the stationary portion and structure for engaging a subterranean formation at an opposing end; and a retaining element extending between the rotatable portion and the stationary portion, the retaining element extending into the retaining region defined by the inner wall of the stationary portion.

2. The rotatable cutting element of claim 1, wherein the retaining element includes a wall interface surface extending at a complementary angle to the angle of the retaining region of the inner wall.

3. The rotatable cutting element of claim 1, the inner wall further comprising a retaining face extending radially away from the longitudinal axis of the stationary portion, the retaining face oriented to be substantially transverse to the longitudinal axis.

4. The rotatable cutting element of claim 3, wherein the retaining face is configured to interface with a top surface of the retaining element.

5. The rotatable cutting element of claim 1, wherein the retaining element comprises a C-shaped ring configured to be deformed and return to an original shape.

6. The rotatable cutting element of claim 1, wherein the retaining element is configured to extend away from the rotatable portion and apply a force to the inner wall.

7. The rotatable cutting element of claim 6, wherein an interface between the retaining element and the angle of the inner wall is configured to apply an axially inward force to the rotatable portion in response to the force applied to the inner wall by the retaining element.

8. An earth-boring tool comprising:

a body;

a rotatable cutting element secured to the body, the rotatable cutting element including:

a sleeve secured to the body, the sleeve defining a cavity;

a rotatable element disposed in the cavity of the sleeve, the rotatable element including a cutting table and a spindle, the spindle extending into the cavity;

an annular retaining element extending between a retaining groove defined in the spindle and a retaining surface defined in the cavity, the retaining element comprising a shaped memory alloy, wherein the retaining element is configured to transition from a flat ring shape to a conical ring shape when exposed to a triggering temperature.

9. The earth-boring tool of claim 8, wherein the triggering temperature is between about 150° F. and about 600° F.

10. The earth-boring tool of claim 8, wherein the conical shape is configured to apply a biasing force between the retaining surface of the cavity and an inner surface of the retaining groove.

11. The earth-boring tool of claim 8, wherein the shaped memory alloy comprises a nickel titanium alloy.

12. A method of assembling a rotatable cutting element, the method comprising:

training a shaped memory alloy ring to a conical ring shape;

lowering a temperature of the shaped memory alloy ring to below a trigger temperature of the shaped memory alloy ring;

compressing the shaped memory alloy ring into a retaining groove on a spindle of a rotatable portion of the rotatable cutting element;

disposing the spindle of the rotatable portion into a cavity defined in a stationary portion of the rotatable cutting element;

heating the rotatable cutting element to a temperature above the trigger temperature of the shaped memory alloy ring; and transitioning the shaped memory alloy ring from a flat ring shape to the conical ring shape.

13. The method of claim 12, wherein heating the rotatable cutting element comprises manually applying heat to the rotatable cutting element.

14. The method of claim 12, wherein heating the rotatable cutting element comprises exposing the rotatable cutting element to downhole conditions including a temperature greater than the trigger temperature of the shaped memory alloy.

15. The method of claim 12, wherein disposing the spindle of the rotatable portion into the cavity defined in the stationary portion comprises disposing the spindle of the rotatable portion into the cavity until the shaped memory alloy ring reaches a retaining region defined in the cavity of the stationary portion.

16. The method of claim 15, wherein disposing the spindle of the rotatable portion into the cavity until the shaped memory alloy ring reaches the retaining region defined in the cavity of the stationary portion comprises disposing the spindle of the rotatable portion into the cavity until the shaped memory alloy ring reaches the retaining region where an inner wall of the stationary portion extends radially away from a longitudinal axis of the rotatable cutting element and includes a retaining face extending substantially transverse to the longitudinal axis of the rotatable cutting element.

17. The method of claim 16, wherein heating the rotatable cutting element to the temperature above the trigger temperature of the shaped memory alloy ring causes the shaped memory alloy ring to return to the conical shape contacting the retaining face of the inner wall of the stationary portion and contacting an axially inner face of the retaining groove of the spindle of the rotatable portion.

* * * * *